US008684794B2

(12) United States Patent
Lefevre et al.

(10) Patent No.: US 8,684,794 B2
(45) Date of Patent: Apr. 1, 2014

(54) CHEMICAL MECHANICAL PLANARIZATION PAD WITH VOID NETWORK

(75) Inventors: Paul Lefevre, Topsfield, MA (US); Oscar K. Hsu, Chelmsford, MA (US); David Adam Wells, Hudson, NH (US); Scott Xin Qiao, Macungie, PA (US); Anoop Mathew, Peabody, MA (US); Guangwei Wu, Sunnyvale, CA (US)

(73) Assignee: FNS Tech Co., Ltd., Cheonan-Si (KR)

( * ) Notice: Subject to any disclaimer, the term of this patent is extended or adjusted under 35 U.S.C. 154(b) by 1438 days.

(21) Appl. No.: 12/185,737

(22) Filed: Aug. 4, 2008

(65) Prior Publication Data

US 2009/0258588 A1 Oct. 15, 2009

Related U.S. Application Data

(60) Provisional application No. 61/044,210, filed on Apr. 11, 2008.

(51) Int. Cl.
*B24B 7/22* (2006.01)
*B24D 3/34* (2006.01)

(52) U.S. Cl.
USPC ..... 451/41; 451/527; 51/298

(58) Field of Classification Search
USPC ..... 451/527, 530, 532, 536, 59, 41; 51/296, 51/297, 298
See application file for complete search history.

(56) References Cited

U.S. PATENT DOCUMENTS 5,302,233 A 4/1994 Kim et al.
5,578,362 A 11/1996 Reinhardt et al.
5,900,164 A 5/1999 Budinger et al.
5,904,615 A 5/1999 Jeong et al.
6,090,475 A 7/2000 Robinson et al.
6,290,883 B1 9/2001 Crevasse et al.
6,652,764 B1 11/2003 Blalock
6,656,018 B1 12/2003 Hsu et al.
6,746,317 B2 6/2004 Blalock
6,758,735 B2 7/2004 Blalock
6,852,020 B2 2/2005 Petroski et al.
7,037,184 B2 5/2006 Petroski et al.
7,252,871 B2 8/2007 Crkvenac et al.
8,016,647 B2 * 9/2011 Chang et al. ..... 451/526

(Continued)

FOREIGN PATENT DOCUMENTS

JP 2-88165 3/1990
WO 2008/011535 1/2008

OTHER PUBLICATIONS

International Search Report dated Nov. 4, 2008 issued in related International Patent Application No. PCT/US08/72144.

(Continued)

*Primary Examiner* — Robert Rose

(74) *Attorney, Agent, or Firm* — Grossman, Tucker, Perreault & Pfleger, PLLC

(57) ABSTRACT

A polishing pad and a method of producing a polishing pad. The method includes providing a mold, having a first cavity and a second cavity, wherein the first cavity defines a recess, providing a polymer matrix material including void forming elements in the recess, forming a polishing pad and removing at least a portion of the elements from the polishing pad forming void spaces within the polishing pad by one of a chemical method or mechanical method, prior to use in chemical/mechanical planarization procedures.

25 Claims, 4 Drawing Sheets

(56) References Cited

U.S. PATENT DOCUMENTS

| | | | |
|---|---|---|---|
| 2007/0037487 | A1 | 2/2007 | Kuo et al. |
| 2008/0063856 | A1 | 3/2008 | Duong |
| 2008/0085661 | A1 | 4/2008 | Hsu et al. |

OTHER PUBLICATIONS

Office Action from corresponding Japanese Application No. 2011-503960 dated Nov. 6, 2012. English translation attached.

* cited by examiner

CHEMICAL MECHANICAL PLANARIZATION PAD WITH VOID NETWORK

CROSS REFERENCES TO RELATED APPLICATIONS

The present application claims the benefit of the filing date of U.S. Provisional Application No. 61/044,210, filed on Apr. 11, 2008, the teachings of which are incorporated herein by reference.

FIELD OF THE INVENTION

The present disclosure relates generally to chemical mechanical planarization (CMP) pads and, in particular, to CMP pads including a network of voids within the pad matrix. The voids may be formed by supplying a pad with a plurality of elements dispersed in a polymer matrix, and removing the elements to provide a corresponding void.

BACKGROUND

In applying CMP (Chemical Mechanical Planarization) as a process step in the manufacture of micro-electronic devices such as semiconductor wafers, blanket silicone wafers and computer hard disks, a polishing pad may be used in conjunction with an abrasive-containing or abrasive-free slurry to affect planarization of the surface of the device. To achieve a high degree of planarity of the surface of the device, typically measured in the order of angstroms, the slurry flow should be distributed uniformly between the surface of the device and the pad. To facilitate such uniform distribution of the slurry, a plurality of grooves or indentation structure may be provided on a polishing pad. The plurality of grooves may have individual groove widths of 0.010 inches to 0.050 inches, depths of 0.010 inches to 0.080 inches and distance between adjacent grooves of 0.12 inches to 0.25 inches, respectively.

While the grooves may provide the above-mentioned benefits, nevertheless, they may not be sufficient to effect local planarization on the die (or single microchip) level on a semiconductor wafer. This may be due to the relatively large differences between the grooves and the individual features, such as interconnects, on the microchip. Advanced ULSI and VLSI microchips, for example, may have feature sizes on the order of 0.35 micrometers (0.000014 inches) that are many times smaller than the width and depths of the individual grooves on the polishing pad. In addition, the feature sizes on a microchip are also thousands of times smaller than the distance between the adjacent grooves, which may result in non-uniform distribution of the slurry on a feature size level.

In an effort to improve upon the uniformity of local, feature-scale planarization, CMP pad manufacturers have, in some instances, provided asperities or high and low areas on the surface of the pads. These asperities may have a size ranged from 20 to over 100 micrometers. While, such asperities may be closer in size to that of the microchip features, as compared to the grooves, the asperities may change in shape and size during the polishing process, and may require continuous regeneration by abrading the polishing pad surface with a conditioner fitted with diamond abrasive particles. The diamond abrasive particles on the conditioner continuously scrape off the surface asperities that are deformed as a result of frictional contact between the pad, the slurry and the surface of the device, and expose new asperities to maintain consistency of planarization. The conditioning process, however, may be unstable, as it may utilize the sharp diamond particles to sever the deformed asperities. The severance of the deformed asperities may not be well controlled, resulting in changes in the size, shape and distribution of the asperities that in turn may cause variation in the uniformity of planarization. Furthermore, the frictional heat generated from conditioning may also contribute to the non-uniformity of planarization, by changing the surface properties of the pad, including properties such as shear modulus, hardness and compressibility.

SUMMARY

An aspect of the present disclosure relates to a method of producing a polishing pad. The method may include providing a mold having a first cavity and a second cavity, wherein the first cavity defines a recess. A polymer matrix material including void forming elements may be provided in the recess. A polishing pad may be formed and at least a portion of the elements may be removed from the polishing pad forming void spaces within the polishing pad by one of a chemical method or mechanical method, prior to use in chemical/mechanical planarization procedures.

Another aspect of the present disclosure relates to a device for polishing. The device may include a pad comprising a polymer matrix having a plurality of voids defined within the polymer matrix, wherein the voids have a length to diameter ratio of 4:1 or greater and the voids are at least partially interconnected.

A further aspect of the present disclosure relates to a method of polishing. The method may include providing a substrate for polishing having a surface, providing an aqueous slurry on at least a portion of the surface of the substrate, providing a pad comprising a polymer matrix having a plurality of voids defined therein, wherein the voids have a length to diameter ratio of 4:1 or greater and the voids are at least partially interconnected and polishing the surface by the interaction of the substrate, the aqueous slurry and the pad.

A still further aspect of the present disclosure relates to a polishing pad for polishing a surface of an electronic substrate, Such pad may include a polymeric matrix including voids, wherein the pad has a first working surface for polishing and a second surface. The pad may also be defined as having a thickness T extending from the pad working surface to the second pad surface, wherein the voids are located only in a region from the pad surface to a thickness of 0.95(T).

Finally, yet another aspect of the present disclosure relates to a polishing pad for polishing a surface of an electronic substrate, comprising a polymeric matrix including voids, wherein the pad has a first working surface for polishing and a second surface. The pad may also be defined by a thickness T extending from the pad working surface to the pad second surface. The polishing pad may also include a region where the voids are uniformly distributed, and a region where the voids are not present, wherein the region where the voids are not present comprises at least 5.0% of the pad volume.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1A:
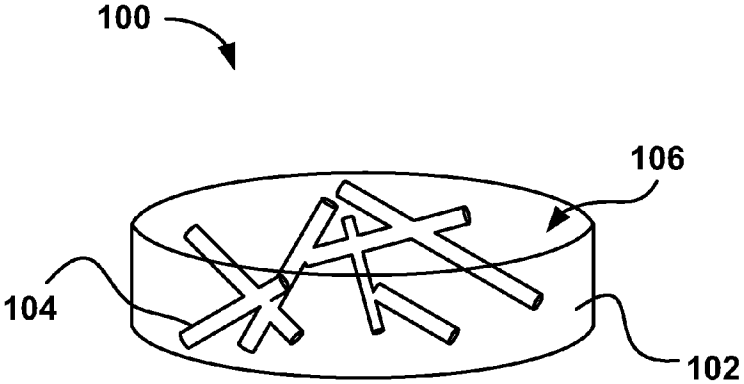
FIG. 1*a* illustrates an example of a void network included in a CMP pad contemplated herein.

It is to be understood that this disclosure is not limited in its application to the details of construction and the arrangement of components set forth in the following description or illustrated in the drawings. The embodiments herein are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The present disclosure relates to a chemical-mechanical planarization (CMP) pad and, in particular, a chemical-mechanical planarization pad that may include a network of voids. The chemical mechanical planarization pad may be utilized during a semiconductor fabrication process for planarizing a wafer or other substrate. The CMP pad may be used in combination with a slurry, which may or may not include abrasives, lubricants and/or other additives.

Figure 1B:
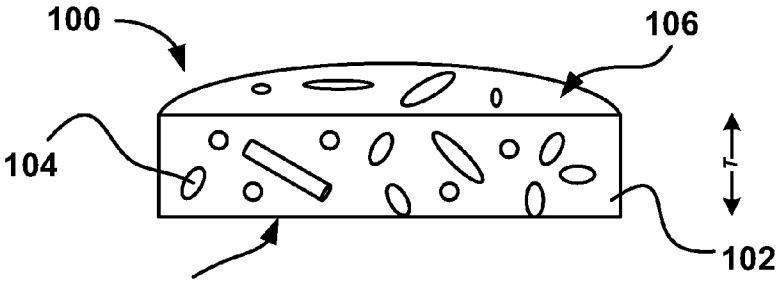
FIG. 1*b* illustrates a cross-sectional view of a CMP pad, including a void network therein.

The CMP pad may be formed of a polymer matrix, as illustrated in FIGS. 1*a* and 1*b*. The CMP pad 100 polymer matrix 102 may include polyurethane, polycarbonate, polyamide, polyesters, polyolefins, polysulfone, polyimide, polystyrene, polymethylmethacrylate, polytetrafluoroethylene, polybutadiene styrene acrylate copolymers, and combinations and/or copolymers thereof. In addition, a CMP pad may be formed by providing a pre-polymer or polymer pre-cursor and solidifying the polymer pre-cursor by curing. In one example, the CMP pad may include a urethane pre-polymer and a curing agent, supplied to crosslink or polymerize the urethane pre-polymer.

The CMP pad may include a number of interconnecting voids 104. The voids may be a void network, defined by or encapsulated in the polymer matrix. The void network may be interconnecting or non-interconnecting. In addition, the voids in the network may be uniformly distributed, randomly distributed or distributed in patterns or gradients within the pad. In one example, the largest portion of voids may be located closest to the working surface 106 of the CMP pad, with the volume of voids decreasing towards the opposite (non-working) surface 108 of the pad or vice versa. That is the largest portion of voids may be located proximal to the opposite surface 108 and the volume of voids decreasing towards the working surface 106. The working surface of the CMP pad may be understood as the surface of the CMP pad that contacts the surface to be planarized or polished. In another example, the voids may be relatively uniformly distributed, wherein given volumes of the pad matrix may include relatively similar void volumes.

Figure 1C:
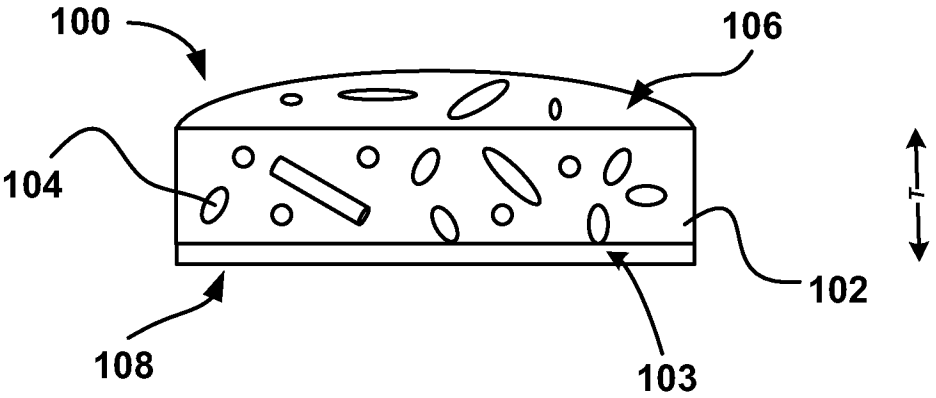
FIG. 1*c* illustrates a cross-sectional view of a CMP pad, including a void network selectively located within a thickness of the pad.

For example, for a pad having a thickness T (see FIG. 1*c*) extending between the working surface (i.e. the surface utilized for polishing) to the non-working surface of the pad, the void containing region may be isolated to only that portion of the pad that extends up to 95% of the thickness of the pad, or 0.95 T. For example, the voids may extend to 10% of the pad thickness (0.10 T), or 20% (0.20 T), or 30% (0.30 T), or 40% (0.40 T), or 50% (0.50 T), etc, up to 95%. As shown in FIG. 1*c*, the pad may therefore contain a region 103 where no voids are present (i.e. voids suitable for polishing). For example, for a pad having a thickness 0.50 inches, the voids may only be present in the upper 0.475 inches of the pad, and the lower 0.025 inches of the pad may contain no voids, which may therefore be understood as a non-void containing domain. As may be appreciated, this may provide a more efficient pad design, as the voids are now only selected located within that region of the pad thickness where polishing is intended to occur.

It may therefore now be appreciated herein that the voids formed in the CMP pad herein are such that they are not limited to formation on the working surface of the pad, but may be formed three-dimensionally and within a selected portion of the pad volume. Stated another way, voids may be formed at some distance from the working surface, so that the voids may then be immediately available when the pad is used in a polishing operation, and the pad surface is worn away over time. That is, with the polishing pads herein, it is not necessary to utilize the pads in the CMP operation to first develop voids, such as relying upon a given polishing slurry to interact with the pad and form one or more voids, as the voids are already present and selectively located to optimize CMP procedures.

The void spaces may be 0.1 μm or greater in diameter or cross-section (i.e. the largest cross-sectional axis) including all values and ranges therein, such as 0.1 μm to 500 μm, in 1.0 μm increments. The voids may therefore usefully accommodate slurry. That is, the void structure may provide pores that enhance the polishing rate and uniformity by increasing the mobility of the abrasive particles in the slurry while reducing scratching of the polished surface. In other words, the pores may act as temporary storage areas for the abrasive particles, thus reducing highly frictional contact between the abrasive particles and the polished surface. A preferred range is 20 μm to 200 μm. In addition, the void spaces may exhibit a length to diameter ratio (L:D) of 4:1 or greater, including any ratio in the range of 4:1 to 1000:1, including fractional numbers as well as whole numbers. For example, the voids herein may have a L:D ratio of 25:1 to 1000:1.

The void spaces herein may also assume a number of desired geometries, which is another advantage of the methodology herein. For example, the voids may be fibular, tubular, cylindrical, spherical, oblong, cubical, rectangular, trapezoidal, as well as other three-dimensional or multi-faceted shapes. That is, by controlling the conditions for removal of the void forming elements from the polishing pad (as explained more fully below), different shapes, and in particular shapes other than round or spherical, may be provided. Furthermore, the individual void spaces may also partially connect or totally connect with other void spaces. The overall voids within the CMP pad may be in the range of 0.1 to 95% by pad volume, including all values and increments therein.

The voids may be formed by elements positioned within the CMP pad matrix. The elements may include, for example, fibers or particles, all or a portion of which may be selectively evacuated or removed from the pad once the pad has been formed. For example, the fibers may be formed into a woven or non-woven fabric or mat. Processes of forming a non-woven mat may include spunbonding, melt spinning, melt blowing, needlepunching, etc. The void forming elements may also be formed of material such a polyvinyl alcohol, polyacrylate, alginate, polyethylene glycol, or combination thereof. In addition, the void forming elements may be formed from soluble materials, which may be understood as materials that may sufficiently dissolve in a selected solvent to form a void. Furthermore, the elements may be formed by hollow fibers.

One example of a method of producing a CMP pad including selectively formed void spaces may begin by placing void forming elements, i.e., fibers, such as in the form of a fabric or mat, or particles into a mold. The polymer matrix material may be poured or located in resin form around the fibers and cast or heated. An optional stamping operation may be performed and the CMP pad may be cured to form a matrix around the elements. A portion of the fibers may then be dissolved or removed from the CMP pad matrix. For example, 10% to 100% of the fibers may be removed from the pad matrix. In addition, as alluded to above, the voids may be formed in selected areas of the CMP pad. For example, the voids may be selectively formed in an upper half (e.g. the upper vertical cross-section) or working portion of the CMP pad and the remainder of the pad may not contain any voids. Prior to, or after the formation of the voids, the CMP pad may be ground or buffed to remove the skin on the pad surface, to thereby expose the voids. In addition, the CMP pad surfaces may be grooved and/or perforated and the CMP pad may be affixed or laminated to a sub-pad and/or pressure sensitive adhesive.

In addition, it should now be appreciated that by providing the feature that the voids are such that they may be partially interconnected, the removal of the void forming elements to provide interconnected void formation is thereby facilitated. In other words, when removing the void forming elements form the pad, and forming interconnected voids, the feature of having elements that produce partially interconnected voids can allow for the formation of the voids through-out a selected region of a given pad volume.

Figure 1D:
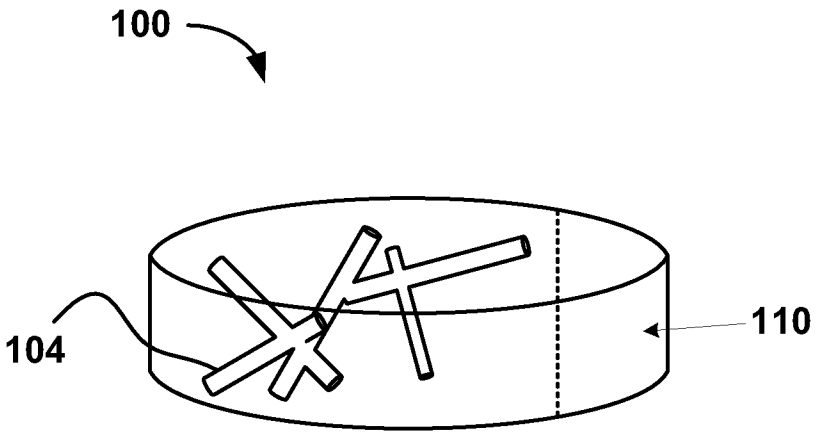
FIG. 1*d* illustrates a cross-sectional view of a CMP pad, including a void network selected located with a region of the pad.

In that sense, it may be appreciated that one can therefore prepare a pad that quite apart from having voids present at a selected thickness (see again, FIG. 1*c*), the pads may be such that they may have a region anywhere within the pad that includes voids, and a region anywhere within the pad that does not include voids, such that the voids are not uniformly distributed within the pad. As therefore illustrated in FIG. 1*d*, a pad may be produced herein where the pad contains a region 110, defined at any location both horizontally and vertically in the pad, where no voids (i.e. voids suitable for use in CMP polishing) are present.

Similar to the considerations noted above for controlling the presence of voids within a given pad thickness, for a given pad volume, the region where such voids are not present within the pad may now be selected herein to be from 5-95% of the available pad volume, including all values and increments therein. Or, stated another way, the pads herein may contain voids within a given percent of the volume of the pad where the voids may be uniformly distributed, as well as a region where no voids (i.e. voids suitable for use in polishing) are present. For example, such region where no voids may be present may be 5%, 10%, 15%, etc., up to 95% of the pad volume.

Furthermore, the region where no voids are present (see again region 110 in FIG. 1*d*) is a region that does not contribute to the volume of the pad where the voids are present. Furthermore, reference to uniformly distributed voids may be understood as that situation where the voids, when present in a given volume of the pad, are generally distributed throughout a given polymer matrix, where the relative distance between the pores does not vary by more than +/−10% or less, such as +/−9%, +/−8%, +/−7%, down to a value of +/−0.1%.

Various methods may be utilized to remove the elements from the CMP pad. The elements may be removed by chemical methods, prior to exposure to polishing slurry, which may be understood as dissolution by a fluid (liquid and/or gas). Such dissolution may occur at elevated temperature, pressures and/or flow rates for the fluid that is selected. The fluid may therefore include water and/or an organic solvent, wherein the water and organic solvent may be selected to allow for a regulated amount of the elements to be removed (selectively dissolved) with corresponding void formation.

In addition, or independent to the use of a chemical methods, the CMP pad may be exposed to mechanical methods, such as vibration, pulsation, ultrasonics, or compression (pressurization) and/or relaxation (reduced pressure) during pad preparation, and once again, prior to exposure to polishing slurry, to generate a desired void network. Accordingly, in the context of the present disclosure, the voids are such that they may be selectively formed, in selected locations of the pad, by the application of chemical and/or mechanical methods, prior to exposure to slurry during a given pad polishing procedure.

In addition, with respect to either or both of the above referenced chemical or mechanical methods, one may regulate the applied heat (temperature) during the void formation. Accordingly, the chemical and/or mechanical methods described herein may be understood as a method of void formation that occurs outside of the polishing environment, with its own set of variables to control the formation of voids, which voids are then utilized to improve polishing efficiency.

With respect to the chemical methods, it may now be appreciated that the solubility of the elements may be regulated, which would then control the ultimate void formation, again, prior to a polishing operation, upon exposure to a fluid. In addition, one may include an additional component that may influence the solubility of the elements to the external parameter (chemical or mechanical) to similarly influence the size and number of voids that may be produced. For example, as noted to above, one may use a fluid that amounts to a mixed solvent system, where one solvent is capable of dissolving the void forming elements, and one solvent is not capable of dissolving the void forming elements. Accordingly, this procedure will allow one to control the number and size of voids formed in a given pad, by controlling the relative amounts of two solvents used to treat the pad, for a selected time period, at a given temperature range, prior to the pad being used for wafer polishing.

Figure 2:
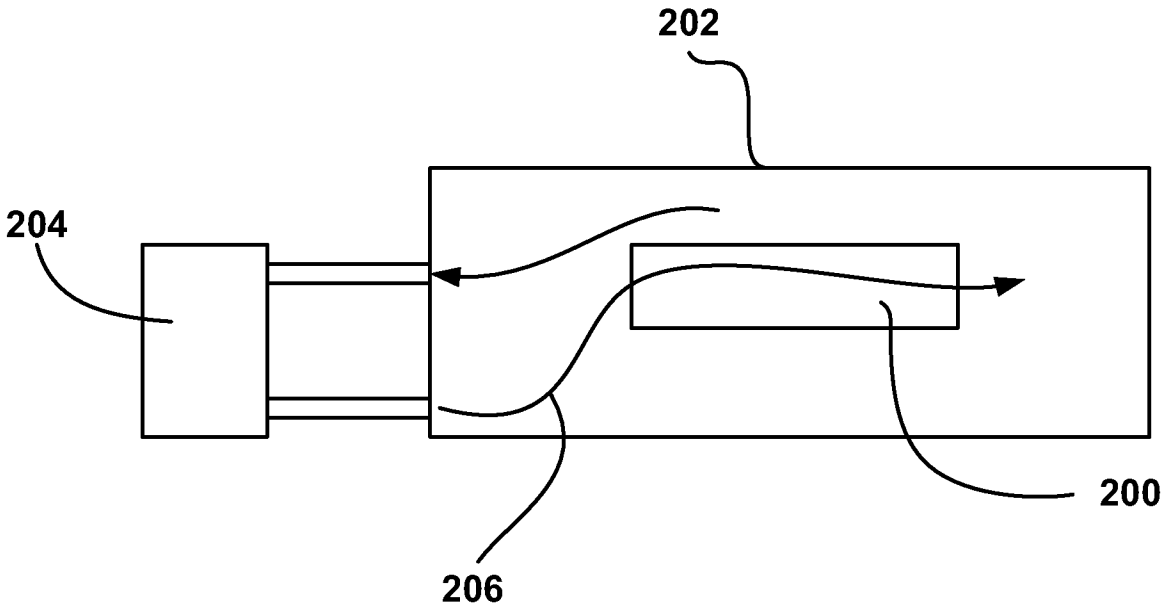
FIG. 2 illustrates a system for forming the voids in a CMP pad.

As illustrated in FIG. 2, an exemplary CMP pad 200 with elements therein may be positioned within a tank 202, which may be pressurized. A pump 204 may force heated fluid (water and/or an organic solvent or a mixture of solvents) 206 through the tank and into the CMP pad at various pressures to dissolve and remove a soluble fiber mat from the CMP pad, and form voids. The pad may then be removed from the tank, ultrasonically cleaned in de-ionized water, or another fluid, and dried. The fluid used for forming the voids may include a variety of additives for increasing the dissolution rate. For example, a surfactant may be added to the fluid, which may lower surface tension between the fiber, polymer matrix and/or fluid. In another example, fresh water (i.e. water not previously exposed to the pad) rather than re-circulated water, may be run through the tank with the CMP pad in the tank. Other solvents may include organic solvents, such as organic alcohols, ketones (e.g. acetone), etc. The solvent selection may therefore be one that is capable of dissolving the elements in the pad designed to be dissolved and provide void locations.

Expanding upon the above, the relative pressure within the tank 202 may be increased or decreased, in a manner that is designed to enhance or regulate the interaction of a given fluid and a given element within the pad configured to be dissolved and provide a void. For example, the pressure may be increased, to provide an increase in the number of voids produced, or decreased to reduce the relative number of voids produced. Pressures that are contemplated herein may include pressures in the range of 1-1000 psi, including all values and increments therein.

In a further example, mechanical methods, such as ultrasonics, may be utilized alone or in combination with pressure to remove the elements from the CMP pad to provide voids. For example, an ultrasonic vibration may be provided or induced in the tank or directly to the CMP pad to produce vibrations of a given frequency or frequency range. Once a sufficient volume of voids have been formed, which may be due to the combined effects of fluid selection and vibration level, the CMP pad may be removed from the tank and dried having a selected concentration of voids of a selected size and at selected locations in the pad. The ultrasonic frequency range may be in the range of 15-70 KHz, including all values and increments therein.

In another example, the void spaces may be produced by providing an additive capable of being volatized, to the pad, such as in the resin formulation utilized for forming the pad matrix. The vaporizable additives may be triggered to form a gas by exposure to heat or other energy sources. Accordingly, one may use a solid compound such as a blowing agent, which may be understood as an inorganic or organic substance that may decompose and/or convert to a secondary compound, and form a gas, which gas may then produce the above referenced void structure. The blowing agent may therefore initially be present as a solid particle and/or as a liquid. Examples of blowing agents may include azodicarbonimide, and liquid blowing agents may include relatively low molecular weight compounds with relatively high vapor pressures, which also may be mixed with a pad matrix precursor, and then volatilize upon pad curing due to the exothermic reaction associated with polymerization that typically occurs during cure. As may therefore be appreciated, the pad matrix precursor may amount to monomers and/or oligomers which may then cure and polymerize to relatively high molecular weight.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A method of producing a polishing pad, comprising:

providing a mold, having a first cavity and a second cavity, wherein said first cavity defines a recess;

providing a polymer matrix material including void forming elements in said recess, wherein said void forming elements comprise one or more of the following: particles and a fabric;

forming a polishing pad having a working surface for polishing and removing at least a portion of said elements from said polishing pad forming void spaces at a distance from the working surface and within said polymer matrix of said polishing pad by one of a chemical method or mechanical method, prior to use in chemical/mechanical planarization procedures.

2. The method of claim 1, wherein said polymer matrix material comprises a polymer matrix pre-cursor.

3. The method of claim 1, wherein removing at least a portion of said elements comprises dissolving said elements.

4. The method of claim 1, wherein said elements are removed under pressure.

5. A method of producing a polishing pad, comprising:

providing a mold, having a first cavity and a second cavity, wherein said first cavity defines a recess;

providing a polymer matrix material including void forming elements in said recess;

forming a polishing pad having a working surface for polishing and removing at least a portion of said elements from said polishing pad via pressure and forming void spaces at a distance from the working surface and within said polymer matrix of said polishing pad by one of a chemical method or mechanical method, prior to use in chemical/mechanical planarization procedures.

6. The method of claim 1, wherein said elements further comprise fibers.

7. The method of claim 1, wherein said element comprise a soluble material.

8. The method of claim 1, wherein said elements are formed from hollow fibers.

9. The method of claim 1, wherein said void spaces have a diameter of 0.1 μm or greater.

10. The method of claim 1, wherein said void spaces are at least partially connected.

11. The method of claim 1, wherein said void spaces have a length to diameter ratio of 4:1 or greater.

12. The method of claim 1, wherein the void volume of the CMP pad may be in the range of 0.1 to 95% by total volume of the pad.

13. The method of claim 1 wherein prior to use in chemical/mechanical planarization procedures comprises prior to exposure to a polishing slurry.

14. A device for polishing, comprising:

a pad comprising a polymer matrix including a working surface and having a plurality of voids defined within said polymer matrix and at a distance from said pad working surface, wherein said voids have a length to diameter ratio of 4:1 or greater and said voids are at least partially interconnected, and said voids assume the form of one or more of the following: particles and a fabric.

15. The device for polishing of claim 14, wherein said void volume is in the range of 0.1 to 90% by total volume of the pad.

16. The device for polishing of claim 14, further comprising elements.

17. The device for polishing of claim 14, wherein said voids are distributed relatively uniformly through a volume of said pad.

18. The device for polishing of claim 14, wherein said voids are distributed in a gradient through a volume of said pad.

19. A method of polishing, comprising:

providing a substrate for polishing having a surface;

providing an aqueous slurry on at least a portion of said surface of said substrate;

providing a pad comprising a polymer matrix and having a working surface for polishing and having a plurality of voids at a distance from the working surface, wherein said voids have a length to diameter ratio of 4:1 or greater, said voids are at least partially interconnected, and said voids assume the form of one or more of the following: particles and a fabric; and polishing said surface by the interaction of said substrate, said aqueous slurry and said pad.

20. A polishing pad for polishing a surface of an electronic substrate, comprising:

a polymeric matrix including voids, wherein said pad has a working surface for polishing said surface of an electronic substrate and a second surface;

said pad having a thickness T extending from said working surface to said second surface;

wherein said voids are located at a distance from said working surface and only in a region from said pad surface up to a thickness of 0.95(T), and said voids assume the form of one or more of the following: particles and a fabric.

21. The polishing pad of claim 20 wherein said voids have a length to diameter ratio of 4:1 or greater and said voids are at least partially interconnected.

22. The polishing pad of claim 20 wherein said voids are located only in a region from said pad surface to a thickness of 0.50(T).

23. The polishing pad of claim 20 wherein said voids have a diameter of 0.1 μm or greater.

24. The polishing pad of claim 20 wherein said voids are uniformly distributed in that region where said voids are located.

25. A polishing pad for polishing a surface of an electronic substrate, comprising:

a polymeric matrix including voids, wherein said pad has a first working surface for polishing said surface of an electronic substrate and a second surface;

said pad having a thickness T extending from said first working surface to said second surface;

wherein said polishing pad includes a first region where said voids are uniformly distributed, and a second region where said voids are not present, wherein said second region comprises at least 5.0% of the pad volume and wherein said voids are located at a distance from said working surface, and said voids assume the form of one or more of the following: particles and a fabric.

* * * * *